US006610231B2

(12) United States Patent
Takizawa et al.

(10) Patent No.: US 6,610,231 B2
(45) Date of Patent: Aug. 26, 2003

(54) MOLDING METHOD FOR A SURFACE FASTENER

(75) Inventors: Toshiaki Takizawa, Toyama-ken (JP); Ryuichi Murasaki, Toyama-ken (JP)

(73) Assignee: YKK Corporation, Tokyo (JP)

( * ) Notice: Subject to any disclaimer, the term of this patent is extended or adjusted under 35 U.S.C. 154(b) by 19 days.

(21) Appl. No.: 09/960,656

(22) Filed: Sep. 24, 2001

(65) Prior Publication Data

US 2002/0056177 A1 May 16, 2002

Related U.S. Application Data

(62) Division of application No. 09/602,470, filed on Jun. 23, 2000, now Pat. No. 6,357,087.

(30) Foreign Application Priority Data

Jun. 28, 1999 (JP) ..... 11-181800
Sep. 22, 1999 (JP) ..... 11-268243

(51) Int. Cl.[7] ..... B29C 47/18

(52) U.S. Cl. ..... 264/167; 264/177.16; 425/381; 425/382.3; 425/465; 425/466

(58) Field of Search ..... 264/167, 177.16, 264/177.1; 425/380, 381, 382.3, 465, 466

(56) References Cited

U.S. PATENT DOCUMENTS 3,252,181 A * 5/1966 Hureau ..... 425/224
3,422,648 A * 1/1969 Lemelson ..... 72/17.2
3,551,543 A * 12/1970 Mercer et al. ..... 264/167
3,708,833 A 1/1973 Ribich et al.
3,932,090 A * 1/1976 Brumlik ..... 425/381
5,345,659 A 9/1994 Allan
5,634,245 A 6/1997 Rouser et al.
5,749,129 A 5/1998 Murasaki et al.
5,913,482 A 6/1999 Akeno
6,066,281 A * 5/2000 Provost ..... 264/167
6,127,018 A 10/2000 Akeno et al.
6,209,177 B1 4/2001 Murasaki
6,357,087 B1 * 3/2002 Takizawa et al. ..... 24/452

FOREIGN PATENT DOCUMENTS

| | | |
|---|---|---|
| EP | 0 324 577 | 7/1989 |
| EP | 0 811 331 | 12/1997 |
| EP | 0 931 472 | 7/1999 |
| JP | 53-22889 | 11/1978 |
| JP | 11-206422 | 8/1999 |

OTHER PUBLICATIONS

European Search Report dated Sep. 9, 2002.

* cited by examiner

*Primary Examiner*—Mark Eashoo
(74) *Attorney, Agent, or Firm*—Finnegan, Henderson, Farabow, Garrett & Dunner, L.L.P.

(57) ABSTRACT

The molding method for molded surface fastener for molding a flat substrate and a plurality of first engaging elements integrally and continously using the same molding material. According to the method, a cooling/transportation means for cooling and transporting a molded surface fastener at the same time when it is molded is driven and rotated in one direction and molten resin material is extruded continuously onto a cooling/transportation face through a resin extrusion path which extends in a width direction of an extrusion nozzle and which is open to said cooling/transportation face of said cooling/transportation means and opens in a transportation direction thereof. At this time, a plurality of the first engaging-element-molding openings spaced in the width direction of said resin extrusion path are opened and closed by means of at least a vertically vibrating member disposed on a front face of said extrusion nozzle in a resin transportation direction thereof.

2 Claims, 11 Drawing Sheets

MOLDING METHOD FOR A SURFACE FASTENER

This is a division of application Ser. No. 09/602,470, filed Jun. 23, 2000, issued as U.S. Pat. No. 6,357,087 which is incorporated herein by reference.

BACKGROUND OF THE INVENTION

1. Field of the Invention

The present invention relates to a molded surface fastener made of thermoplastic synthetic resin material having engaging elements each having a novel shape, which are integrally molded on a surface of a flat substrate independently of each other, the surface fastener having a particular function, and also relates to molding method and molding apparatus therefor. More specifically, it relates to a molded surface fastener which can be molded in various sizes from minute size to normal size, is suitable for various applications owing to its novel shape and function and can be produced continuously with a high efficiency by a single process by a simplified production apparatus, and a molding apparatus and molding method therefor.

2. Description of the Related Art

Conventional molded surface fasteners are manufactured in various methods. One typical manufacturing method is complete batch manufacturing method by injection molding. According to another typical manufacturing method, a die wheel having a plurality of engaging-element-molding cavities on a peripheral face thereof is driven and rotated in one direction and molten resin material is introduced continuously to the peripheral face of the die wheel so as to mold a flat substrate with engaging elements continuously and integrally. According to these methods, engaging elements of various shapes such as palm-like, hook-like or the like can be molded.

According to still another method, a plurality of substantially T-shaped engaging-element-molding extruding ports are provided in an extruding die and a flat substrate molding extruding ports are formed by communicating bottoms of the respective T-shaped extruding ports with each other. By extruding molten resin from the extruding ports at the same time, a plurality of ribs each having a substantially T-shaped cross section on a surface of the flat substrate are molded continuously and the molded molten resin material is hardened. Then, with the flat substrate remained, the aforementioned ribs are cut in a direction perpendicular to an extending direction of the ribs or at an appropriate inclination angle into a predetermined thickness successively, so that substantially T-shaped engaging elements are formed. By extending the flat substrate in a molding direction after the cutting, the cut individual engaging elements are separated with a desired pitch, thus a molded surface fastener is produced.

According to these molding methods, the shapes and dimensions of the engaging elements are limited if productivity thereof is engaged. On the other hand, if the shapes and dimensions of the engaging elements are provided with variety to some extent, it is difficult to mold them continuously or the quantity of production steps is increased, so that productivity decreases. In either case, these methods have both advantages and disadvantages.

Particularly, according to the above-mentioned method in which a drawing process is performed after the ribs of molten resin molding material on the surface of the flat substrate are cut from the extruding die and in which an engaging head portion can have a variety of sectional shapes to some extent, four steps, i.e. extrusion, rib cutting, heat drawing and cooling are required as disclosed in, for example, Japanese Patent Publication No. 53-22889. Of these steps, particularly the rib cutting requires a high processing accuracy, so that a quite large amount of labor and time are consumed for maintenance and control therefor.

The above-mentioned publication discloses a proposal that the aforementioned rib cutting process should be simplified and the heating extension process should be eliminated. According to this proposal, an extrusion-molded product having a plurality of ribs on the surface of the flat substrate is introduced onto a rotating drum and rotated substantially by a half turn in accordance with a rotation of the drum. During this rotation, two cutting blades, which are disposed in parallel to a rotation axis of the drum, of a cutting device are reciprocated in a direction of a chord with respect to the peripheral face of the drum so that the ribs are cut. At this time, a cutting angle when the extruded product is rotated on the peripheral face of the drum is utilized. By cutting twice with a difference of phase of about 80° along the peripheral face of the drum, the ribs is cut into a V shape. Then, engaging elements whose front shape is substantially T shape and side view is substantially isosceles triangle are formed continuously.

However, in not only the aforementioned molded surface fastener produced by the cutting as mentioned above but also the molded surface fastener molded by the conventional molding cavities, a flat surface is necessarily formed on at least one of the side faces or front or rear faces of an engaging element, so that an edge portion is formed between the adjacent flat faces. This edge portion is likely to cut a loop which is a mating engaging element at the time of engagement and gives an uncomfortable feeling when touched.

In a molded surface fastener except the aforementioned extruded fastener, a configuration of a molding cavity needs to be complex if a shape of an engaging element is designed to be complex. However, such a complex molding cavity cannot be produced, so that necessarily only an engaging element of a simple shape can be obtained. On the other hand, in the molded surface fastener produced by extrusion, at least the front shape of each engaging element can be complex. However, because the molded ribs are separated into individual engaging elements by cutting the molded rib, its front and rear end faces of the engaging element are only a combination of the aforementioned flat surfaces. Therefore, a further complex configuration such as the one having curved faces is difficult to produce.

According to not only the manufacturing method of the surface fastener by extrusion and cutting but also the manufacturing method of the surface fastener by a die wheel or molding die, the flat substrate and engaging elements are entirely cooled at the same time. Therefore, the flat substrate and engaging elements of a completed surface fastener are the same in materiality. If they are cooled rapidly after molded, crystallization is not accelerated so that the entire structure becomes flexible. Consequently, the engaging strength and peeling strength may become insufficient. If they are cooled gradually, on the other hand, the crystallization is accelerated so that the entire hardness is increased. Consequently, the engaging strength and peeling strength increase and at the same time, the hardness of the flat substrate is also increased, so that the surface fastener becomes entirely stiff.

Further, in the engaging element of the aforementioned surface fastener produced by extrusion and cutting, a front or rear cross section of the engaging element perpendicular to the extruding direction is always the same. Particularly, it is impossible to mold an protruding end of the engaging element at a sharp angle. Thus, when the engaging element are a male one having equal dimensions, especially if a loop of a mating female engaging element is minute, the male engaging element cannot invade into the loop easily. As a result, the engagement rate drops, so that sufficient engaging strength and peeling strength cannot be secured.

SUMMARY OF THE INVENTION

The present invention has been achieved to solve the above described problems and an object of the invention is to provide a molded surface fastener which ensures an improved engagement rate, sufficient engaging strength and peeling strength although it has engaging elements each having a novel shape that did not exist in a conventional art and is entirely provided with high flexibility, and an effective manufacturing apparatus and method thereof.

The inventors of the present invention have already publicized a molded surface fastener which is a basis of the present invention as well as a molding apparatus and method thereof via Japanese Patent Laid-Open Publication No. 11-206422. The present invention has been obtained by further developing the invention that was disclosed in said publication. That is, in the aforementioned disclosed invention of said publication, the configuration of the molded surface fastener, for example, is not sufficiently stabilized. Therefore, the apparatus and method as well require further consideration in order to achieve the configuration stabilization of the product. Therefore, a number of considerations were taken even after the aforementioned proposal was submitted.

As a result, it was recognized that if viscosity of the molding resin is adjusted appropriately, the configuration of the product can be stabilized and that the configuration is a novel one that was not seen conventionally, which is a feature of the present invention. Further, it was also recognized that a physical property different from the conventional one can be gained, and that molding principle is not misunderstood. However, the viscosity of the molding resin differs depending on the molding material and molding condition. Therefore, the viscosity cannot be specified uniformly for all kinds of the molding materials or all kinds of molding conditions.

As a result of further accumulated considerations and experiments, the inventors of the present invention have achieved an invention on a molded surface fastener, a molding apparatus and a molding method for the molded surface fastener, which are described below. Consequently, products having the aforementioned physical property can be produced efficiently in a stabilized condition so that the aforementioned object can be achieved effectively.

According to a first aspect of the present invention, there is provided a molded surface fastener comprising a flat substrate and a plurality of first engaging elements molded of the same material integrally with each other, wherein the engaging element is composed of a stem portion standing from a surface of the flat substrate and an engaging head portion protruded from a tip of the stem portion at least in one side direction perpendicular to a molding direction thereof; a thickness of the first engaging element in a direction perpendicular to the protruding direction of the engaging head portion increases gradually from a top portion of the engaging head portion to a base end of the stem portion; and lateral widths between front and rear end faces of the engaging head portion of the first engaging element in the molding direction are different from each other.

The molded surface fastener having such a specific configuration of the present invention can be molded in a stabilized condition according to a molding apparatus and method that will be described later. Because in the above molded surface fastener, the thickness of the first engaging element increases gradually from the top portion of the engaging head portion to a base end of the stem portion, the engaging element is not bent easily by a force (shearing force) parallel to the surface of the flat substrate or a pressing force acted obliquely from above the substrate. When a loop which is a mating female engaging element is pulled obliquely upward in a condition that it engages the stem portion, the loop is necessarily introduced to a border area between the stem portion and engaging head portion, so that the engaging head portion does not become loose in the loop, thereby the engagement not being released easily. Further, because the width of each engaging element in a back and forth direction increases gradually from the top portion to front ends thereof, the engaging element is more likely to be inserted into the mating loop when it is pressed for engagement.

Further, protruding lengths of the front and rear end faces of the engaging head portion of the first engaging element which is a feature structure of the present invention are different. That is, when the engaging head portion is seen from top, it assumes a substantially trapezoidal shape. An end portion on the front end face side extending longer is a sharp edge, so that it is more likely to be inserted into a loop which is a mating female engaging element. As a result, the engagement rate is improved and total engaging strength is increased, owing to the above described structure as well.

Because an opening shape of the first engaging-element-molding openings in the molding apparatus of the present invention can be formed arbitrarily, a shape of the first engaging element as viewed from front can be formed in diversified dimensions and shapes such as substantially T shape, substantially Y shape, palm tree shape, a single hook shape, a mushroom shape or their combination or such that its external contour as viewed from front is curved. Further, a height or a length of the engaging element can be changed freely.

Further, a plurality of second engaging elements are molded on a back surface of the flat substrate. Therefore, because the molded surface fastener of the present invention has the first and second engaging elements on the front and rear faces thereof, the engaging faces of the female surface fasteners can be engaged with each other via the molded surface fastener of the present invention. Each of the second engaging elements to be molded on the rear face of the flat substrate can be formed in diversified shapes as conventional ones such as the hook shape, palm tree shape, T shape, Y shape, and mushroom shape.

Furthermore, lateral widths of front and back end faces of the stem portion of the first engaging element in the molding direction are different from each other. Because the stem portion also provides a substantially trapezoidal shape as well as the above described shape of the first engaging element, the shape of the engaging element during use is stabilized so that its initial engaging/disengaging function is maintained for a long time even if it is used repeatedly.

Still further, there is provided a molded surface fastener, wherein hardness of the flat substrate is set lower than hardness of the engaging head portion. Conventionally, in this kind of the molded surf ace fastener, through hardening by cooling after a product is molded is rapid cooling or gradual cooling, the flat substrate and engaging elements are hardened by cooling under the same condition. Therefore, an entire product has a substantially equal hardness. As a result, if flexibility is regarded as important, the engaging element itself becomes flexible, but the engaging strength decreases. If the engaging strength is regarded as important, the entire product becomes stiff. Consequently, applications of the product are limited. However, according to the present invention, because the hardness of the substrate is lower than that of the engaging element but the entire surface fastener is sufficiently flexible but the engaging element still maintains a desired hardness. Thus, owing to the above described specific configuration as well, the engaging element is not bent easily by a pressing force of a mating female surface fastener member. Consequently, the engagement rate with the loops which are the mating engaging elements is improved largely, so that its application field is expanded largely.

Still further, a shorter-width rear end face of the engaging head portion of the first engaging element in the molding direction, assuming a substantially trapezoidal shape as viewed in plan, is curved in the width directions and bulges backward. With such a structure, the engaging loops, which are the mating female engaging elements, becomes easy to move forward along the curved rear end face when disengaged. Thus, different from the conventional rectangular engaging head portion, a smooth disengaging operation is enabled without deforming the engaging head portions excessively. On the contrary, after the protruding end of each engaging head portion is inserted into the loop which is the mating female engaging element, the loop is introduced smoothly up to the border between the engaging head portion and stem portion along the curved face of the engaging head portion. Thus, there exists no edge portion between flat surfaces unlike conventional ones, and therefore a secure engagement can be achieved.

Still further, rear end faces of the stem portion and engaging head portion of the first engaging element in the molding direction are composed of curved faces continuous in a vertical direction thereof. Conventionally, an engaging element in which an end face of an engaging head portion and an end face of a stem portion opposite to the extending direction of the engaging head portion are composed of curved faces has been well known. In case of the molded surface fastener, usually, right and left end faces perpendicular to the extending direction of the engaging head portion are composed of parallel flat faces. However, in the first engaging element of the present invention, of front and rear end faces perpendicular to the extending direction of the engaging head portion, at least the rear end face of the engaging head portion and stem portion, which is an end face opposite to the molding direction, is curved vertically. The right and left end faces corresponding to the aforementioned flat faces at the right and left end faces of the conventional engaging element can be molded in an arbitrary curved face by setting second openings in the extrusion nozzle of the molding apparatus according to the present invention in an arbitrary shape.

Because most the contour of the engaging element can be composed of curved faces, not only tactile feeling is excellent but also when the surface fastener is engaged, a loop which is a mating female engaging element can be introduced into the engaging head portion easily. Further, when the surface fastener is disengaged, it can be released without applying an excessive force upon the loop. That is, the surface fastener can be engaged or disengaged smoothly.

Still further, the flat substrate has a concave groove which is located between first adjacent engaging elements along the protruding direction of the engaging head portion and continuous perpendicular to the protruding direction. By forming the concave groove in the surface of the substrate, an actual thickness of the flat substrate is reduced with respect to an apparent thickness thereof so as to increase flexibility and at the same time, prevent an occurrence of cracks in the substrate between the engaging elements adjacent in their back and forth direction. Further, side walls of the concave groove functions as a guide face for introducing a mating loop to the base end of the engaging element, thereby improving the engagement rate with the loop.

Still further, orientations of resin material on surface portions of the front/rear end faces and right/left side faces of the stem portion and engaging head portion respectively, and a top portion of the engaging head portion of each first engaging element are directed in the molding direction.

In the surface fastener molded according to a molding principle which is a feature of the present invention, a large tensile strength parallel to the molding direction of the flat substrate exists. This tensile strength can be expected in the conventional method for molding the engaging elements with the engaging-element-molding cavities. However, a tensile strength in a vertical direction along the front and rear end faces in the molding direction of the engaging element is increased largely according to the present invention, which cannot be expected in the aforementioned molding method for molding the engaging elements by cutting and extending after ribs are extruded. Therefore, a rupture strength of the engaging element is increased. By molding the front and rear end faces in the molding direction, the right and left end faces and the top portion of the engaging head portion of the engaging element by extrusion and vibration of the vertically vibrating member when the engaging elements are molded according to the present invention, resin material on all the surface layer portion of the engaging element is oriented in the molding direction, so that the tensile strength in the molding direction is increased.

A passing speed of the molten resin at this time is constant. When a vibration speed of the extrusion nozzle is changed, an increased amount of the resin passing through the openings within a unit time becomes a molded amount in a rotating direction of a die wheel, so that the molded engaging element becomes longer in the rotating direction of the die wheel. According to the present invention, it is possible to arbitrarily determine a molding length of the first engaging element by controlling the vibration speed to be constant or varied. Specifically, it is possible to make the same lengths of the first engaging elements by setting the vibration speed to be constant. Alternatively, it is possible to vary the lengths of the first engaging elements by changing the vibration speed during the molding.

The molded surface fastener having such a configuration is molded effectively by means of a molding apparatus which will be described below.

According to a second aspect of the present invention, there is provided a molding apparatus for molded surface fastener for molding a flat substrate and a plurality of engaging elements integrally and continuously using the same molding material, comprising: a cooling/transportation means adapted to be driven and rotated in one direction for molding and transporting at least part of the flat substrate between an extruding die and the cooling/transportation means; an extrusion nozzle disposed at an end side of transportation by the cooling/transportation means of the extruding die, opposing a rotating transportation face of the cooling/transportation means and having a resin extrusion path which is open in a transportation direction; at least an vertically vibrating member disposed in front of the resin extrusion path for opening/closing vertically at least part of the resin extrusion path; and at least a vibrating means for vibrating vertically the vertically vibrating member, wherein the resin extrusion path has at least plural first engaging-element-molding openings spaced in the width direction.

The vertically vibrating member is preferably composed of a plate-like member.

A basic molding principle of the surface fastener of the present invention is the same as the molding principle of the surface fastener proposed by the inventors of the present invention in Japanese Patent Laid-Open No. 11-206422. However, the molding apparatus of the present invention has features in the following points. First, in order to mold the surface fastener continuously, molten resin is extruded from the extruding die directly to a cooling/transportation face of the cooling/transportation means driven an rotated in one direction. Second, the molten resin extruded to the cooling/transportation face and carried on the cooling/transportation face continuously is introduced through the resin path and molded to be the first engaging elements on the flat substrate face successively by means of the vertically vibrating member on a front face of the first engaging-element-molding openings.

The molten resin extruded from the extruding die to the cooling/transportation face is cooled directly by the transportation face so that hardening thereof is started. Then, while the molten resin passes through the resin flow path, it is molded to have an engaging element cross section defined by the flow path and at the same time the cooling is accelerated up to inside of its structure. As a result, the entire hardness is intensified more than the molten state just after it is extruded from the extruding die and then, the resin hardened is molded to be a shape of the engaging element by vibration of the vertically vibrating member. Because the engaging elements are molded by the vibration of the vertically vibrating member in half molten state in which a higher hardness is secured than that when the molten resin is extruded from the extruding die, contraction which may occur when molded can be suppressed and dragging of resin by the vertically vibrating member can be also restrained, so that a much stabilized desired shape can be obtained.

Because the molded resin is cooled most rapidly in the flat substrate and the cooling speed is retarded as it goes toward a vertex of the engaging head portion of the first engaging element, crystallization of the engaging element is progressed more than the crystallization of the flat substrate when a final product is produced. As a result, hardness of the flat substrate is lower than that of the first engaging elements and therefore, although flexibility of the entire surface fastener is secured, a desired hardness and a sufficient engaging strength are secured in engaging element.

Further, the cooling/transportation means is composed of a cooling drum adapted to be driven and rotated in one direction. Instead of a conventional expensive die wheel having engaging-element-molding cavities on its peripheral face, the cooling drum having a smooth surface can be employed. Further, the molding apparatus can be produced only by adding the extrusion nozzle and the up/down vibrating means to a conventional extrusion die. Thus, no consideration upon increase of production cost and equipment space is needed.

On the other hand, according to the present invention, a plurality of second engaging-element-molding cavities may be formed on a peripheral face of the cooling drum. Instead of mainly forming the engaging-element -molding cavities in the surface of the drum, it is permissible to use an existing die wheel already having the engaging-element-molding cavities in its peripheral face. Therefore, the first engaging elements can be molded in the surface of the flat substrate by vibration of the vertically vibrating member and at the same time, the second engaging elements are molded integrally in the rear surface of the same substrate. As a result, the molded surface fastener having the first and second engaging elements on the front and rear surfaces thereof can be molded continuously.

As for the aforementioned cooling means, it is permissible to circulate refrigerant within the rotation drum or immerse half of the rotation drum in a cooling water bath. The cooling/transportation means does not always have to be a drum body, but the cooling endless belt which is to be rotated by driving in one direction may be used. In this case, the endless belt may be made of a steel belt and both ends which are guided by driving/cooling rolls. And a flat supporting member for supporting the belt transportation face rotated by driving between the rolls from inside may be disposed. Of course, it is preferable that the aforementioned supporting member itself be structured as a cooling body.

Furthermore, the vertically vibrating member is comprised of comb-teeth-like first and second vertically vibrating members having opening portions formed such that they do not overlap each other laterally, and the first and second vertically vibrating members are disposed against a front face of the resin extrusion path of the extrusion nozzle and adapted to be lifted up and down alternately by corresponding vibrating means. With such a structure, in a molded surface fastener, a plurality of the engaging elements stands integrally from the surface of the flat substrate in staggered arrangement. Therefore, the engagement rate with the mating loop is distributed equally to an entire surface of the flat substrate.

Still further, a gap between the extrusion nozzle and the cooling/transportation means is set substantially the same as a minimum thickness of the substrate. When the vertically vibrating member opens or closed the engaging-element-molding openings in a vertical direction, a flat substrate having the same thickness as the aforementioned gap is formed. When the vertically vibrating member descends in order to close the engaging-element-molding openings with a desired substrate left, the base ends of the stem portions are left continuously in the molding direction. As a result, a concave groove continuous in the molding direction is formed in the flat substrate.

According to a third aspect of the present invention, there is provided a molding method for molded surface fastener for molding a flat substrate and a plurality of first engaging elements integrally and continuously using the same molding material, comprising steps of: driving and rotating a cooling/transportation means for cooling and transporting a molded surface fastener in one direction at the same time when it is molded; extruding molten resin material continuously onto a cooling/transportation face through a resin extrusion path which extends in a width direction of an extrusion nozzle and which is open to the cooling/transportation face of the cooling/transportation means and opens in a transportation direction thereof; and opening/closing the plurality of first engaging-element-molding openings spaced in the width direction of the resin extrusion path by means of at least an vertically vibrating member comprised of a plate-like member disposed on a front face of the extrusion nozzle in a resin transportation direction.

The above described molding method enables to manufacture the molded surface fastener having the aforementioned configuration continuously in a single production step so that its production unit cost becomes reasonable. On the other hand, in manufacturing a molded surface fastener having the similar configuration according to the conventional extrusion-molding in which a plurality of the ribs each having a T-shaped cross section are formed to stand from the surface of the substrate for example, the rib is cut with a predetermined thickness in a longitudinal direction thereof and then, the cut rib is drawn in a longitudinal direction thereof. Thus, this method is not efficient because plural manufacturing steps are required. Further, front and rear faces of the engaging element of a produced molded surface fastener in the longitudinal direction are flat surfaces parallel to each other because they are composed of cut surfaces as mentioned above. If this is compared with the configuration of the engaging element of the present invention, the engaging element is more likely to fall down in its back and forth direction and its production unit cost is necessarily higher than that of the present invention.

According to the molding method of the present invention, when molten resin is extruded from the extruding die of an extruder directly to the cooling/transportation face of the cooling/transportation means, the extruded molten resin is carried by the cooling/transportation face through the molten resin flow path in the extrusion nozzle. At this time, a contact surface of the molten resin extruded to the cooling/transportation face with the cooling/transportation face is cooled positively so that hardening is started. Then, that cooling is transmitted to the molten resin extruded from the molten resin flow path so that the molded portion of the flat substrate and the molded portions of the first engaging s elements are cooled gradually. The molded portion of the first engaging elements are slightly hardened and becomes into a half molten state at the first engaging-element-molding openings. Then, front and rear faces of the first engaging elements are molded at the openings by an up/down motion of the up/down vibration member.

At this time, a lower limit position of the vertically vibrating member is, for example, such a position that leaves a thickness of the substrate. Specifically, when the molten resin is always extruded from a gap between the extrusion nozzle and the cooling/transportation face in form of a flat sheet, and the vertically vibrating member ascends and descends to the lower limit position so as to mold the first engaging elements successively on a top surface of the flat substrate continuously.

That is, after the vertically vibrating member arrives at the lower limit position, it starts to ascend, so that the engaging-element-molding openings open gradually upward from the lower limit. At this time, the flat substrate whose hardening is progressed is carried continuously by the cooling/transportation face and at the same time, the stem portions and engaging head portions of the first engaging elements are molded along the shape of the openings by extruding successively from a lower portion thereof depending on a degree of their openings, in a state in which the molded portion of the first engaging element is slightly hardened. Finally, the vertically vibrating member reaches the top limit of the openings to mold front end faces of the stem portions and engaging head portions, thus completing molding of front faces of tops of the engaging head portions.

When the lower end of the vertically vibrating member reaches the top end of the openings, almost front half portions of the engaging elements in the extruding direction are molded and then, the vertically vibrating member starts to descend. It closes the engaging-element-molding openings gradually from the top end so as to mold rear half portions of the engaging elements from a top portion thereof to base ends of the stem portions along a reverse step to the molding of the front half portions. Because the molten resin molded by the vertically vibrating member is slightly hardened and has a uniform hardness at this time, the molded shape is stabilized.

Further, due to the cooling mechanism provided by the cooling/transportation means, a surface fastener having a physical property particular to the present invention, which could not be expected in the conventional surface fastener, can be molded. That is, due to a difference of the cooling mechanism between the flat substrate and the engaging elements at the time of molding, hardening of the flat substrate is accelerated based on the positive cooling and as a result, the hardening is completed before crystallization is completely achieved. On the contrary, the engaging elements are cooled by transmission. Thus, the hardening of the engaging elements is delayed, so that crystallization is accelerated and the hardness thereof becomes higher than the substrate. Therefore, although the molded surface fastener is provided with a sufficient flexibility, the engaging strength of the engaging elements is increased. Further, due to the high hardness, the engaging elements are unlikely to be deformed, so that the engagement rate and peeling strength are also increased.

According to the present invention, the half molten thermoplastic resin material extruded from the first engaging-element-molding openings each having a desired cross section of the first engaging element is molded continuously by moving up and down the vertically vibrating member. Thus, resin material of the surface portions of the stem portion, engaging head portion, and top portion of the engaging head portion are oriented in the molding direction. As a result, tensile strength of all the surface portion of the flat substrate and engaging elements in the molding direction is improved so that a rupture strength of the engaging element is improved largely.

On the other hand, a front view shape of the molded engaging element substantially coincides with the shape of each engaging-element-molding opening. Although the front end face shape and rear end face shape as viewed in the molding direction are analogous, the lateral width of the former is slightly larger than that of the latter. This is considered to be generated due to a difference of behavior of extruded molten resin when the vertically vibrating member, which moves up/down on the front faces of the engaging-element-molding openings, opens or closes that openings. That is, when the engaging-element-molding openings are closed, resin pressure is intensified by an extruding pressure because it is enclosed in the resin extruding flow path. Then, when the vertically vibrating member moves upward, the opening is opened suddenly so that the aforementioned resin pressure is released for an instance and more resin than in the normal state is extruded. However, when the vertically vibrating member descends so as to close the openings, extrusion of the molten resin is interrupted instantly. Thus, the extruding amount of the resin may drop below a set value. Consequently, there is generated a difference of the lateral width between the front and rear end faces in the molding direction of the engaging head portion of the first engaging element, which constitutes the feature portion as described above.

On the other hand, as for a side view shape of the first engaging element, it is expanded like a skirt in the back and forth direction of the molding direction with a curve from its top end to its bottom end. Further, by changing a lift-up/down speed of the vertically vibrating member in various ways, the curve expanding like a skirt in the back and forth direction can be changed in diversified shapes. The side view shape is determined by the lift-up/down speed of the vertically vibrating member.

As a result, a surface fastener having a configuration and function which could not be expected in this kind of the conventional surface fastener extrusion molding can be obtained, and efficient molding by a single step which could not be expected in the conventional molding method can be carried out.

Further, a plurality of second engaging elements may be molded integrally on a surface of the flat substrate on an opposite side to the surface on which the first engaging elements are molded at the same time. This molding is achieved by forming the second engaging-element-molding cavities in the transportation face of the cooling/transportation means. In this case, a conventional die wheel having a plurality of the engaging-element-molding cavities on its peripheral face may be used. A surface fastener molded according to this method becomes double-sided molded surface fastener. Depending on the configuration of the engaging element, not only self bonding performance is possessed but also products having loop faces can be joined together via this surface fastener.

BRIEF DESCRIPTION OF THE DRAWINGS

FIGS. 3(A), 3(B) and 3(*c*) are top views of the molded surface fastener and views taken along the lines I—I and II—II respectively of the top view, as viewed in the arrow directions.

DESCRIPTION OF THE PREFERRED EMBODIMENTS

Hereinafter, the preferred embodiments of the present invention will be described in detail with reference to the accompanying drawings.

Figure 1:
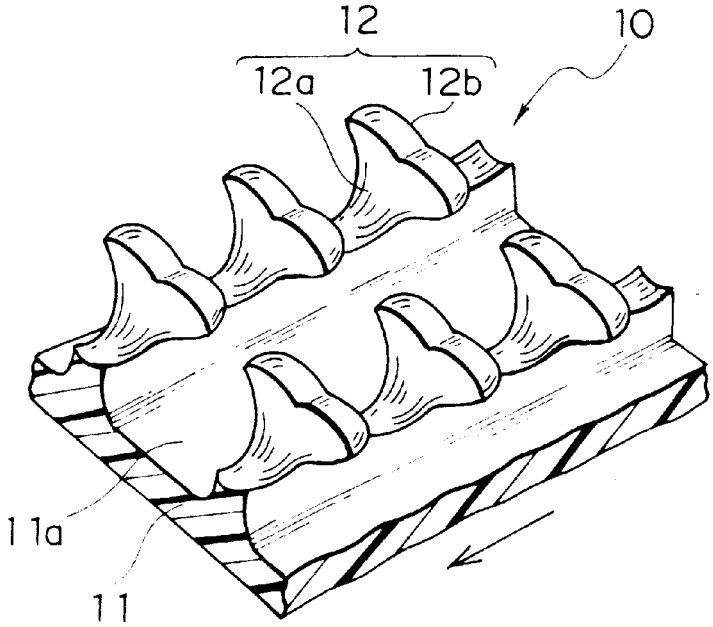
FIG. 1 is a partial perspective view of a molded surface fastener of a typical embodiment of the present invention as viewed from front in a molding direction.
Figure 2:
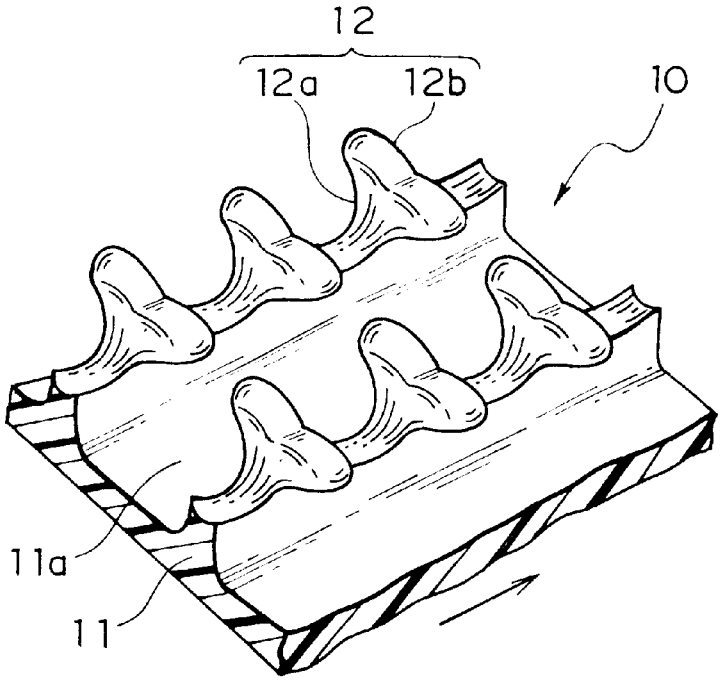
FIG. 2 is a partial perspective view of the molded surface fastener from back in the molding direction.
Figures 3A, 3B, 3C:
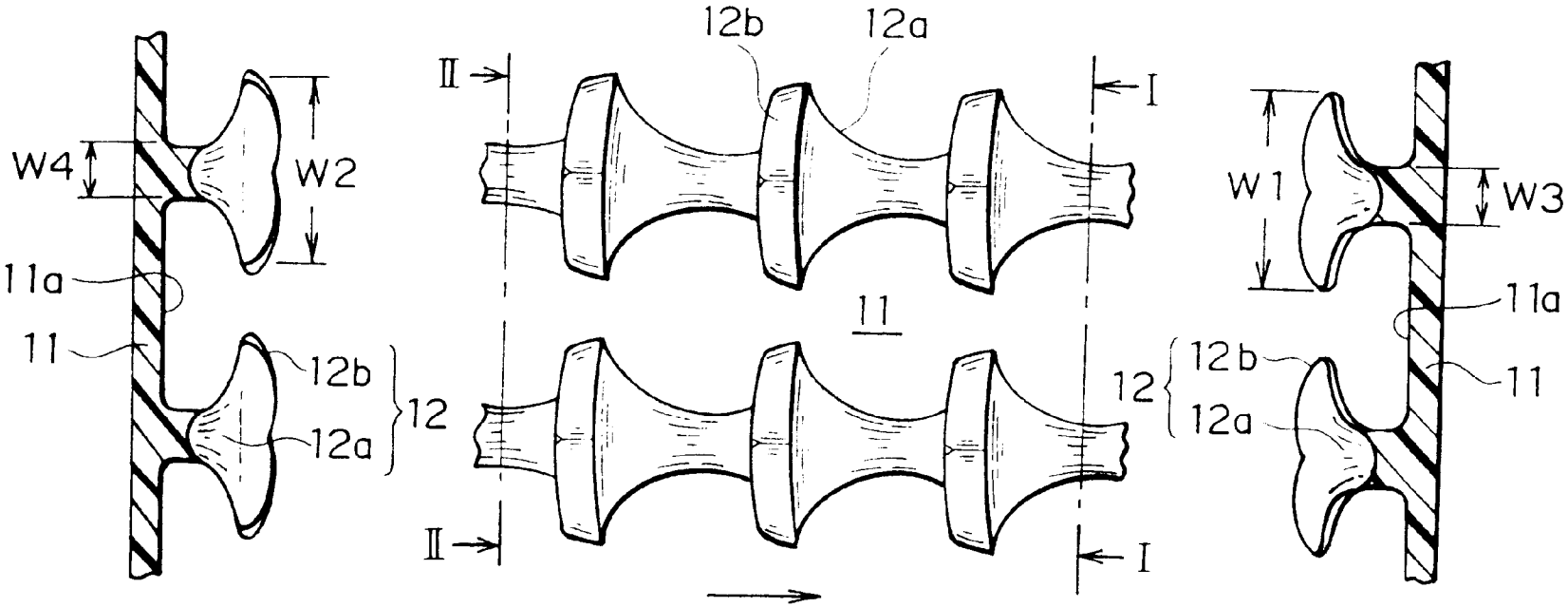
Figure 4:
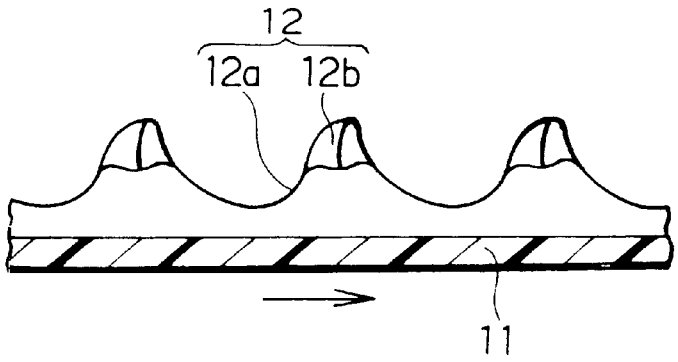
FIG. 4 is a partial side view of the same molded surface fastener.

FIG. 1 is a partial perspective view of a molded surface fastener including an engaging element of a typical shape according to the present invention, as viewed from front in a molding direction, FIG. 2 is a partial perspective view of the surface fastener as viewed from back in the molding direction and FIGS. 3(A), 3(B) and 3(*c*) are a top view of the surface fastener and a front view and rear view in the molding direction. FIG. 4 is a partial side view of the surface fastener. Although the engaging element as shown in these FIGURES is substantially T-shaped as viewed from front, it is permissible to choose any other shape such as a substantially Y shape, substantially inverted L shape, substantially inverted J shape, mushroom shape or else, depending on a shape of an opening 105*b* for molding a first engaging element in a molding apparatus which will be described later. Further, a size of the engaging element having the aforementioned shape may be changed arbitrarily. An arrow as shown in the aforementioned FIGURE indicates a molding direction by the molding apparatus of the present invention.

As understood from these FIGURES, the molded surface fastener 10 of the present invention can be produced easily by continuously molding a flat substrate 11 and a plurality of engaging elements 12 standing from a surface of the substrate 11 to be integral each other through a single process. The engaging element 12 is comprised of a stem portion 12*a* standing directly from the surface of the flat substrate 11 and an engaging head portion 12*b* protruded from a front end of the stem portion 12*a* to at least one side thereof. A thickness of the engaging head portion 12*b* of the engaging element 12 in a direction perpendicular to a direction of its protrusion is gradually increased from a top of the engaging head portion 12*b* to a base end of the stem portion 12*a*.

As shown in FIGS. 1 and 2, the engaging element 12 of this embodiment is substantially T shaped such that top of the engaging head portion 12*b* is cut in slightly downward in a V shape as viewed from its back and forth. The stem portion 12*a* stands with a substantially equal width in the protrusion direction of the engaging head portion 12*b* and joined to the engaging head portion 12*b*. As evident from FIGS. 1 to 3, when the engaging element 12 is viewed from the top, protrusion widths W1, W2 in a lateral direction of the front and rear faces of the engaging head portion 12*b* in the molding direction are different and the engaging element is entirely formed substantially in a trapezoidal configuration. According to this embodiment, the end face width W1 on the front face in the molding direction is longer than the end face width W2 on the rear face. This is the same for the stem portion 12*a*. Such a horizontal sectional shape is a particular shape obtained by a manufacturing method of the present invention, likewise the various shapes that will be described later.

The above described shape of the engaging head portion 12*b* facilitates engagement with a mating loop (not shown). That is, because front corners of the protruded ends at the right and left of the engaging head portion 12*b* are substantially sharp angles, even if the mating loop is small or is not completely opened, the engaging head portion 12*b* can be inserted easily into the loop. When the engaging head portion 12*b* is released from the loop, the engaging head portion 12*b* is not hooked at the neck by the loop being lifted up so that it can be disengaged smoothly from the loop without cutting the engaging head portion 12*b* and/or the loop.

Another characteristic shape of this embodiment is that the thickness of the engaging element 12 in the back and forth of the molding direction increases gradually from a top portion of the engaging head portion 12*b* toward the base end of the stem portion 12*a* standing from the flat substrate 11. This gradually increased shape is not different from a gradually increased shape of a linear flat plane produced when an extruded rib is cut in a V shape, as disclosed in Japanese Patent Publication No. 53-22889. The engaging element 12 is expanded outward from the top portion of the engaging head portion 12*b* to the stem portion 12*a* to form a curved surface, and then at the following stem portion 12*a*, it is expanded inward to form another curved surface.

This curved shape functions to introduce a loop into and between adjacent engaging elements 12 in the molding direction smoothly into the engaging head portion 12*b* when the loop is lifted up. That is, when the loop, which is bent by pressure from the surface fastener and is inserted into and between the adjacent engaging elements 12 in the molding direction, is released from that pressure to be released from the deformation and moves in a direction that the surface fasteners relatively depart from each other, the loop tries to restore to its original shape along an end face of the stem portion 12*a* of the engaging element 12 and then engages the engaging head portion 12*b* halfway of that move.

Still another feature of this embodiment is that the aforementioned rear end of the engaging head portion 12*b* is not linear but expanded outward in the plan view. This shape accelerates the mating loop toward move to the protruded end of the engaging head portion 12*b* when it is departed from the mating loop. That is, if the loop engaging the engaging head portion 12*b* is lifted obliquely forward, the same loop is moved smoothly to the front end corner along the expanded face of the rear end of the engaging head portion 12*b*, so that it can be released without any excessive load being applied to the loop and engaging head portion 12*b*

In the aforementioned engaging element 12 shown in the FIGURES, the dimensions of the stem portion 12*a* in the molding and lateral directions increase gradually toward the base end. Therefore, the engaging element 12 is not fallen down easily by a force (shearing force) parallel to the surface of the flat substrate 11 or a pressing force applied obliquely from above do the substrate 11. When the loop (not shown) which is a mating engaging element is pulled up obliquely upward in a condition that it engages the stem portion 12*a*, it is necessarily introduced to a border area of the engaging head portion 12*b* and the stem portion 12*a*. Consequently, the engaging head portion 12*b* is not floated up in the loop so that the engagement is not released easily. On the other hand, because a back-to-forth width of the engaging head portion 12*b* perpendicular to its protruding direction gradually increases from its top portion toward its front end, the engaging element 12 is more likely to be inserted into a group of mating loops. Further, because each loop is pressed so as to be widened laterally when the engaging elements 12 are inserted, the front end of the engaging head portion 12*b* becomes more likely to be inserted into the mating loop despite the aforementioned configuration. Further, as compared to the conventional engaging element having the same width in the same direction, a neck portion which is the border area between the stem portion 12*a* and engaging head portion 12*b* is scooped out. Consequently, the mating loop which has engaged is prevented from easy disengagement so that engagement rate, engaging force and peeling force all increase.

Further, according to this embodiment, a concave groove 11*a* having a rectangular cross section is formed continuously in the surface of the flat substrate 11 between a plurality of the engaging elements 12 having the first element shape as mentioned above and a plurality of the engaging elements 12 molded on the adjacent rows, formed continuously on the surface of the flat substrate 11 of the molded surface fastener. By forming such a concave groove 11*a*, an actual thickness of the flat substrate 11 with respect to an apparent thickness thereof is decreased so as to increase flexibility and further, the substrate 11 between the adjacent engaging elements 12 becomes resistant to tearing. Further, because a side wall face of the concave groove 11*a* also functions as a guide face for introducing the mating loop to the base end of the engaging element 12, the engagement rate with the loop is improved.

The shape of the engaging head portion 12*b* as viewed from front may be determined arbitrarily, though its illustration here is omitted. That is, the aforementioned shape of the first engaging element 12 is determined by a shape of first engaging-element-molding openings 105*b* of an extrusion nozzle 105, which will be described later. For example, it is possible to replace engaging portions protruded at the right and left of the engaging head portion 12*b* with a single engaging portion or the V-shaped groove to be formed on the top of the engaging head portion 12*b* can be eliminated and instead, just an upward curved shape may be applied. Further, by arranging a protrusion direction of a single engaging portion protruded from an engaging head portion 12*b* of an engaging element 12 in an opposite direction to that of an engaging element 12 adjacent thereto in a direction perpendicular to the molding direction, it is possible to prevent their engagement from having directivity.

The surface fastener having such a configuration can be produced easily according to a molding method and molding apparatus of the invention as described below. According to this molding method, all the engaging elements 12 of the present invention are molded integrally on the surface of the flat substrate 11 such that they are independent, and as compared to the conventional engaging elements obtained by cutting the ribs and drawing the substrate, the entire shape of each engaging element 12 has roundness so that the feel of touch of the surface fastener is enhanced.

Figure 5:
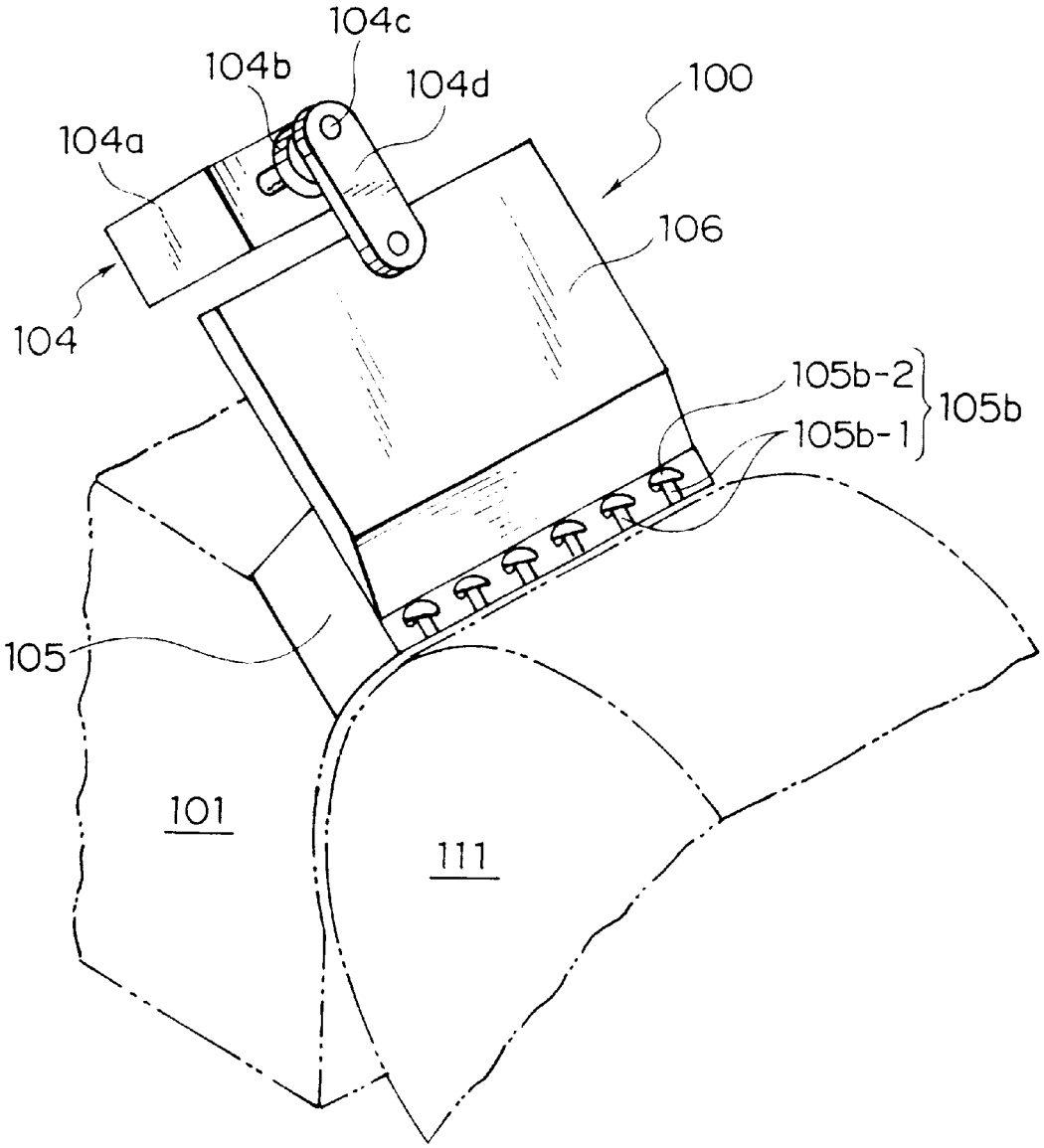
FIG. 5 is a perspective view of a major portion of a molding apparatus for the molded surface fastener according to a first embodiment of the present invention.
Figure 6:
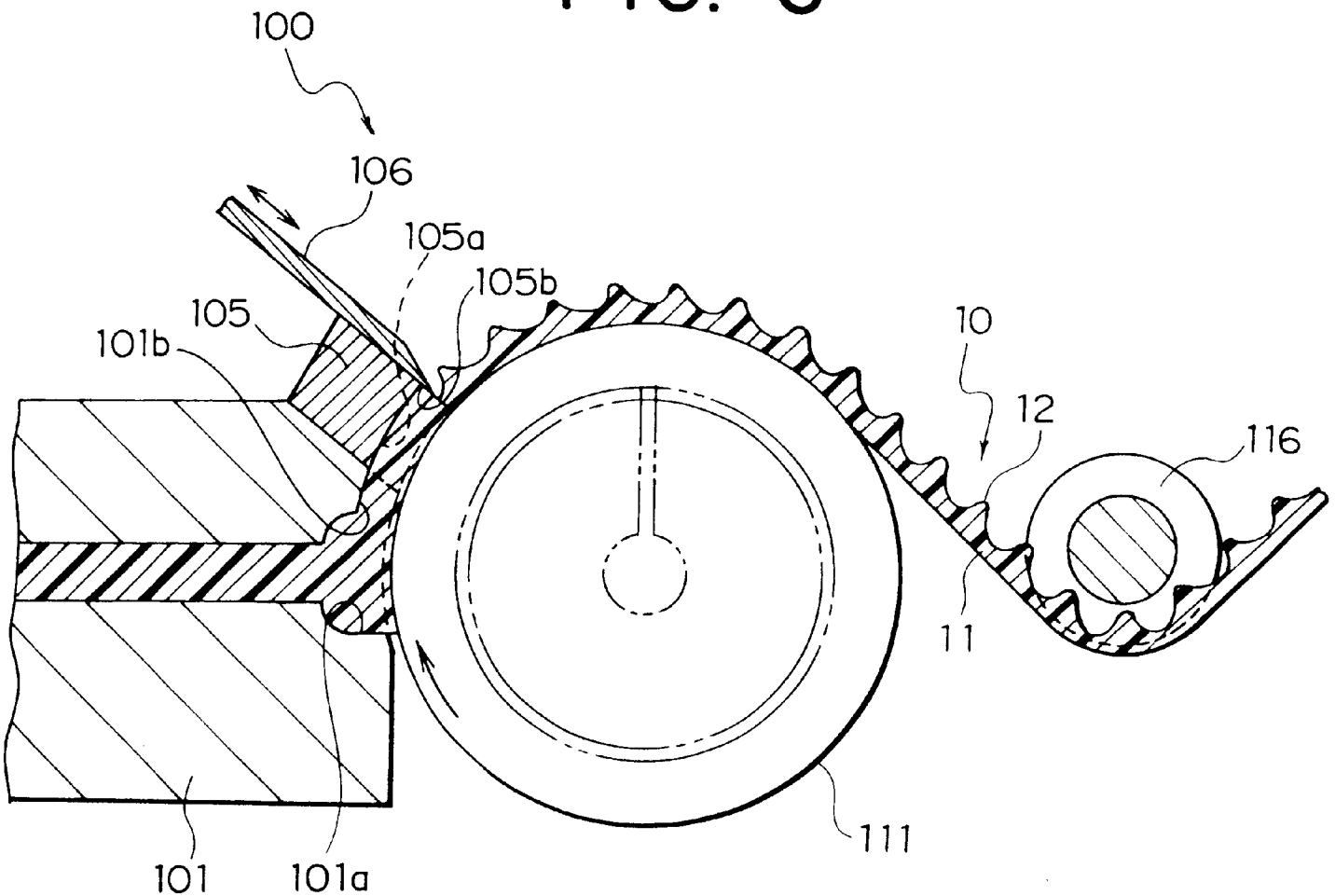
FIG. 6 is a side view schematically showing a molding portion of the molding apparatus for the molded surface fastener, partially in cross section.

FIGS. 5 and 6 show an apparatus according to the first embodiment which is a typical embodiment of a molding apparatus 100 of the present invention. Because this kind of molding apparatus is not different from the conventional structure with regard to the extruder and the like, illustration and description thereof are omitted here.

In these Figures, reference numeral 101 denotes an extruding die mounted to an extruder (not shown). An extruding port 101*a* which communicates with an extruding path inside of the extruding die 101 is provided in the extruding die 101. A peripheral face of a cooling drum 111 which is a cooling/transportation means as a feature of the present invention is provided so as to oppose the extruding port 101*a* of the aforementioned extruding die 101 with a predetermined gap. This gap is set to substantially the same dimension as a required minimum thickness of the flat substrate 11 of the surface fastener 10 to be molded. The peripheral face of the cooling drum 111 is a smooth face and cooling medium flows inside the drum 111. According to this embodiment, cooling water is used as the aforementioned cooling medium.

The cooling drum 111 is driven and rotated in one direction by a driving source (not shown). Further, molten resin flow path 101*b* is formed in the extruding die 101 such that it communicates with the extruding port 101*a* and extends along a rotation direction of the cooling drum 111. An extrusion nozzle 105 having a resin extrusion path 105*a* which communicates with an outlet end face of the molten resin flow path 101*b* is provided on the extruding die 101. According to this embodiment, although the extruding die 101 is heated from inside under control, the extrusion nozzle 105 is maintained in non-heating condition. The aforementioned resin extrusion path 105*a* in the extrusion nozzle 105 is disposed with the same gap with respect to the peripheral face of the cooling drum 111 as the extruding die 101 is. Engaging-element-molding openings 105*b* are formed on a front face of the extrusion nozzle 105 along a rotation direction of the cooling drum 111.

According to this embodiment, an opening shape of each of the aforementioned engaging-element-molding openings 105*b* is substantially T shape whose top end in a center thereof is dented downward in substantially V shape. The engaging-element-molding openings 105*b* are formed with a predetermined pitch along a width direction of the extrusion nozzle 105.

Then, according to the present invention, a vertically vibrating member 106 is disposed so as to make a firm contact with a front face of the extrusion nozzle 105. According to an example shown in the Figure, the vertically vibrating member 106 is made of a rectangular metallic plate-like member having a wedge shaped section in which the surface thereof in contact with the front surface of the extrusion nozzle 105 is flat and a front face thereof is inclined downward to converge at a bottom of the flat face. Then, this vertically vibrating member 106 is vibrated vertically by a vibrating means 104. In the vibrating means 104 as shown in the Figure, a center of a top face of the vertically vibrating member 106 is connected to an eccentric pin 104*c* of a rotating disk 104*b* connected to a rotation driving source such as an electric motor 104*a* through a link 104*d*. It is permissible to provide each of opposite side edge portions of the front face of the extrusion nozzle 105 with a guide face for guiding reciprocation of the vertically vibrating member 106 in a vertical direction.

It will be now described how a molded surface fastener of the typical embodiment as shown in FIG. 1 is molded by means of a surface fastener molding apparatus having the above described structure. Molten resin extruded from the extruding port 101*a* of the extruding die 101 is directly introduced to the peripheral face of the cooling drum 111 which is being driven and rotated in one direction and cooled positively from its contact surface with the peripheral face of the cooling drum 111 and introduced into the resin extrusion path 105*a* of the extrusion nozzle 105. The molten resin is cooled gradually from a bottom face of the flat substrate 11 in contact with the peripheral face of the cooling drum 11 to inside thereof before it reaches the front face of the resin extrusion path 105*a*, and when it is pushed out of the engaging-element-molding openings 105*b* formed on the front face of the resin extrusion path 105*a*, it is cooled to such an extent that some degree of shape retention is possessed and semi-hardened.

Figure 7:
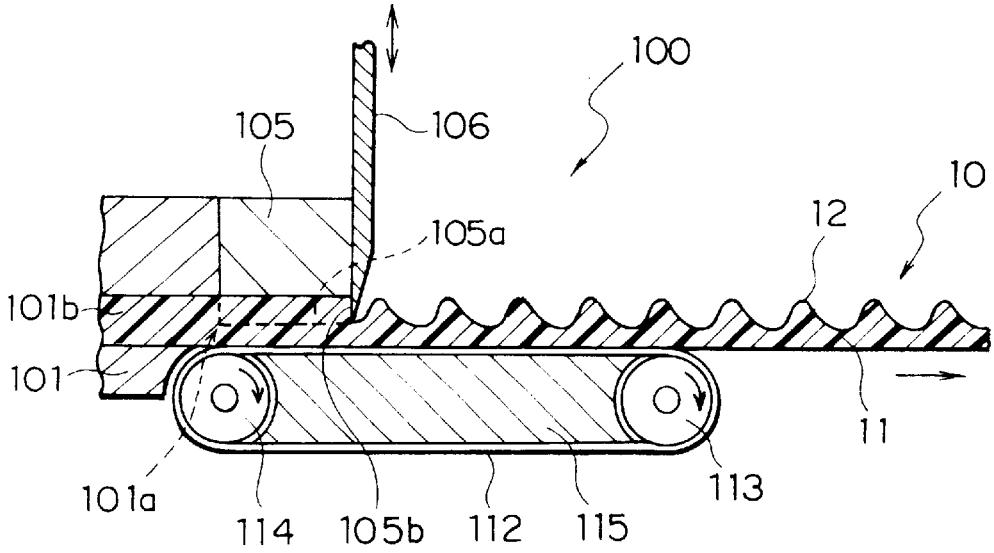
FIG. 7 is a side view schematically showing a molding apparatus for the molded surface fastener according to a second embodiment of the present invention, partially in cross section.

FIG. 7 shows partially a molding apparatus of a second embodiment of the present invention. In the Figure, the extrusion nozzle 105 is provided on a front face of the extruding die 101 so that the molten resin flow path 101*b* of the extruding die 101 communicates with the resin extrusion path 105*a* of the extrusion nozzle 105. In this molding apparatus, a cooling endless belt 112 is employed as a cooling transportation means. This cooling endless belt 112 is composed of an endless belt made of a steel having a smooth surface and rotated by a driving roll 113 and an inversion roll 114 in one direction. A box-like belt supporting member 115 is provided between the driving roll 113 and inversion roll 114. These rolls 113, 114 and the belt supporting member 115 contain a cooling device for cooling the cooling endless belt 112 running along their peripheral faces positively from inside thereof. A bottom face of the resin extrusion path 105*a* of the extrusion nozzle 105 communicating with the extruding port 101*a* of the extruding die 101 is provided so as to oppose an upper face of the belt rotating on the inversion roll 114 with a gap equivalent to a thickness of the flat substrate 11.

According to the present invention, right after since the molten resin is extruded from the extruding port 101*a* of the extruding die 101, it is cooled rapidly by transportation surfaces of the cooling transportation means 111, 112 and then, when it passes through the resin extrusion path 105*a* of the extrusion nozzle 105, it is cooled gradually. Consequently, hardening of the flat substrate 11 is accelerated and a cooling speed of the first engaging elements 12 is relatively retarded so that different physical properties of the flat substrate 11 and first engaging elements 12 can be obtained. That is, although the flat substrate 11 is hardened by the rapid cooling before crystallization is accelerated, the first engaging elements 12 are hardened by the gradual cooling after the crystallization progresses. As a result, the flat substrate 11 is provided with more flexibility than the first engaging elements 12, so that the surface fastener entirely has flexibility and the first engaging elements 12 are molded so as to have a certain degree of hardness and resist deformation but have excellent engaging strength. Meanwhile, according to a result of experiment on the extruding/cooling mechanism as described above, it has been confirmed that a degree of crystallization of the flat substrate 11 is substantially less than 80% of the degree of crystallization of the engaging elements 12.

From when the molten resin is extruded from the extruding port 101*a* of the extruding die 101 until it reaches the engaging-element-molding openings 105*b* of the extrusion nozzle 105, the molten resin is cooled by the transportation surface of the cooling transportation means so that it is in a half-molten state in which the viscosity is raised to some extent. Thus, shape retention of each engaging element 12 can be secured during the following molding of the engaging element 12 so that its molding with a stabilized shape is enabled. If this cooling is retarded, the viscosity of the molten resin extruded from the extrusion nozzle 105 is too low, so that the shape of the engaging element is deformed or twisted and not stabilized.

Just at the instance when the molten resin is extruded from the engaging-element-molding openings 105*b* with the opening sectional shapes, the first engaging elements 12 are molded continuously by the vertically vibrating member 106 reciprocating up and down while being in a sliding contact with the front face of the extrusion nozzle 105. Usually, an upper limit position of the vertically vibrating member 106 is an upper limit position of the engaging-element-molding openings 105*b*, that is, an upper limit position of an engaging-head portion-molding portions 105*b*-2. A lower limit position of the vertically vibrating member 106 is a border line position between the stem portions 12*a* of the engaging elements 12 and a top face of the flat substrate 11.

Therefore, while the surface fastener 10 is molded, flat molten resin in a flat shape is extruded continuously from the gap between the extruding die 105 and cooling drum 111. Then, when the vertically vibrating member 106 goes up and down, the engaging elements 12 are molded in rows integrally on a top face of the flat substrate 11 at a predetermined pitch. In the molding apparatus of the first embodiment, the lower limit position of the vertically vibrating member 106 is set to a bottom ends of stem-portion-molding portions 105*b*-1 of the engaging-element-molding openings 105*b*, namely, slightly above the lower limit position of the openings 105*b* without completely closing the first engaging-element-molding openings 105*b*.

Thus, the engaging elements 12 adjacent in the molding direction are connected with a rib of a predetermined height, and a concave groove 11*a* extending continuously in the molding direction is formed between rows of the engaging elements 12 of the flat substrate 11 adjacent in the molding direction. At this time, the concave groove 11*a* increases flexibility of the substrate 11 by decreasing an actual thickness of the flat substrate 11 with respect to an apparent thickness thereof as described above, and at the same time, makes it difficult for the substrate to be torn between the engaging elements 12 adjacent in the same row. Further, the side walls of the concave groove 11*a* also functions as guide faces for introducing a mating loop to the base end of the engaging element 12, thereby improving the engagement rate with the loop.

Next, the molding mechanism will be described in detail with reference to FIGS. 8 to 11.

Figure 8:
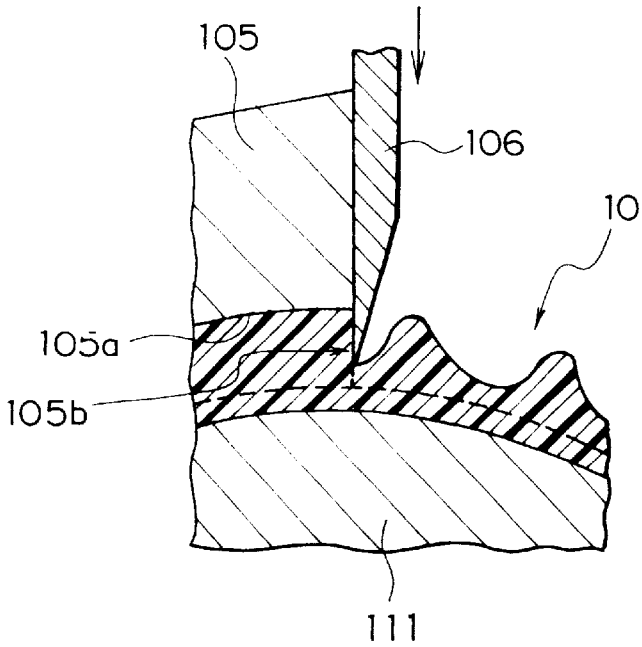
FIG. 8 is an explanatory diagram of a first stage showing a molding principle of a first engaging element in the molded surface fastener of the present invention.
Figure 9:
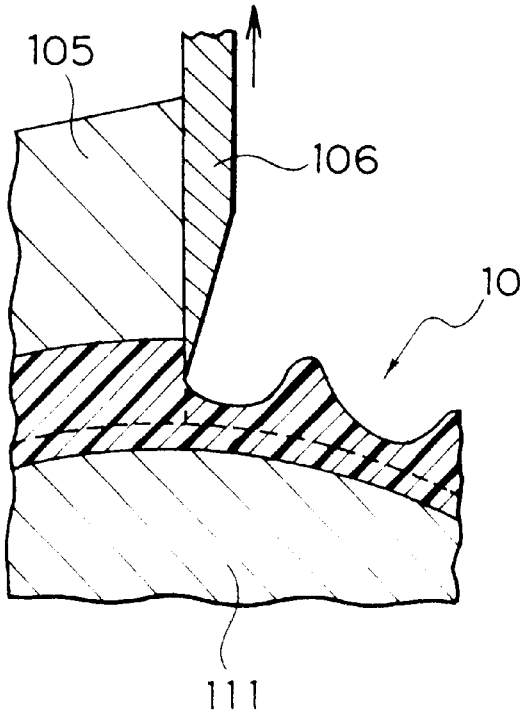
FIG. 9 is an explanatory diagram of a second stage of the molding principle.
Figure 10:
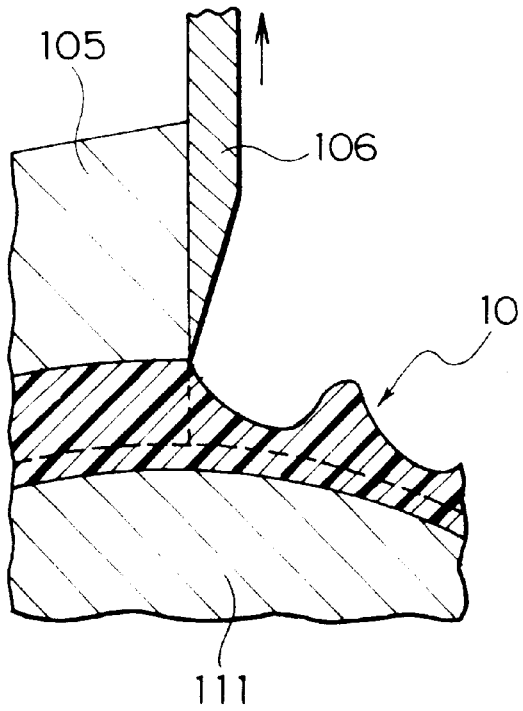
FIG. 10 is an explanatory diagram of a third stage of the molding principle.
Figure 11:
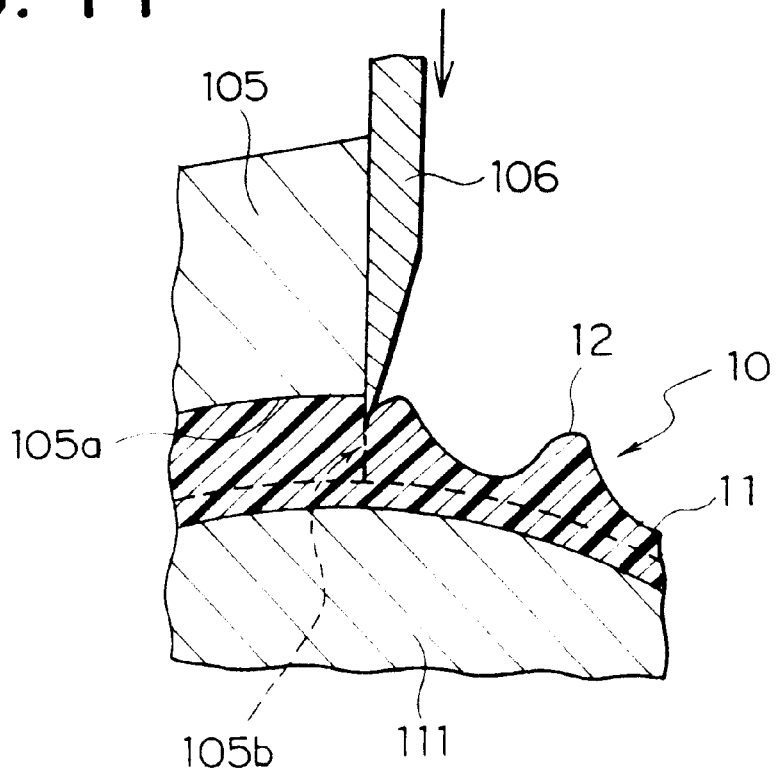
FIG. 11 is an explanatory diagram of a fourth stage of the molding principle.

As shown in FIG. 8, the vertically vibrating member 106 starts to ascend from a state in which it has descended to the lower limit position thereof, so that as shown in FIG. 9, the engaging-element-molding openings 105*b* open gradually from their lower ends upward. At this time, molten resin is pushed out successively from below along the opening shapes in accordance with an opening degree of the openings. When finally the vertically vibrating member 106 reaches an upper limit of the openings 105*b* as shown in FIG. 10, substantially front half portions of the engaging elements 12 in the extruding direction are molded and then, the vertically vibrating member 106 starts to descend. Then, as shown in FIG. 11, it closes the engaging-element-molding openings 105*b* successively from the upper ends. In a reverse manner to the step of molding the front half portions as described above, rear half portions of the engaging elements 12 from their top portions thereof to the base ends of the stem portions 12*a* are molded.

Due to such a molding mechanism, although the front shape of each engaging element 12 substantially coincides with a shape of each engaging-element-molding opening 105*b*, its side shape is determined by an ascending/descending speed of the vertically vibrating member 106. As shown in FIGS. 4 and 8, the side shape of the engaging element 12 has a curved face which expands outward like a skirt from a vertex of its engaging head portion 12*b* to the stem portion 12*a*, and is dented inward such that it expands like a skirt down to a base end of the stem portion 12*a*. Consequently, the curved face is formed such that it is curved forward and backward in the molding direction from the vertex of the engaging head portion 12*b* to the base end of the stem portion 12*a* and expands like a skirt. Further, by controlling an ascent/descent speed curve of the vertically vibrating member 106 in various ways, the forward and backward curved faces which expand like a skirt can be changed in diversified styles.

According to the molding mechanism of the present invention as described above, the molded surface fastener is provided with an unexpected novel configuration. That is, because the first engaging element 12, molded continuously by opening and closing the first engaging-element-molding openings 105*b* by the vertical movement of the vertically vibrating member 106 and continuously extruding the half-molten resin material with a predetermined sectional shape, the molten resin which exists inside the aforementioned openings as being pressed by an extruding pressure is pushed out to a free space at the same time when the first engaging-element-molding openings 105*b* are opened. Because the molten resin is under a higher pressure than the normal resin pressure at this time, the molten resin existing inside the first engaging-element-molding opening 105*b* is extruded out in a more quantity than in the normal state at the moment before the extruding pressure returns to its normal pressure, whereby so that the front half portion of each engaging element 2 is molded. After this front half portion is molded, the vertically vibrating member 106 moves to its closing action for the first engaging-element-molding openings 105*b* so as to close the openings 105*b* successively from the upper ends. Due to that closing, the amount of the extruded resin gradually decreases successively. As a result, the rear half portion of each engaging element 12 becomes such a shape that is slightly more contracted than the front half portion. As illustrated in FIGS. 1 to 3, the engaging head portion 12*b* represents a variance in the shape most conspicuously.

Further, the molding mechanism of the present invention provides the surface fastener with an unexpected novel physical property. That is, because the engaging elements 12 are molded of the half-molten resin material extruded from the engaging-element-molding openings 105*b* with predetermined cross sections continuously by the opening/closing action of the engaging-element-molding openings 105*b* by means of the vertically vibrating member 106, the molding resin material is oriented in a direction in which it is molded along a movement of the vertically vibrating member 106. That is, the resin material disposed on surface layers of the front and rear end faces of the stem portion 12*a* and engaging head portion 12*b* of the engaging element 12, and a surface layer of the vertex of the engaging head portion 12*b* is oriented in the molding direction.

Figure 12:
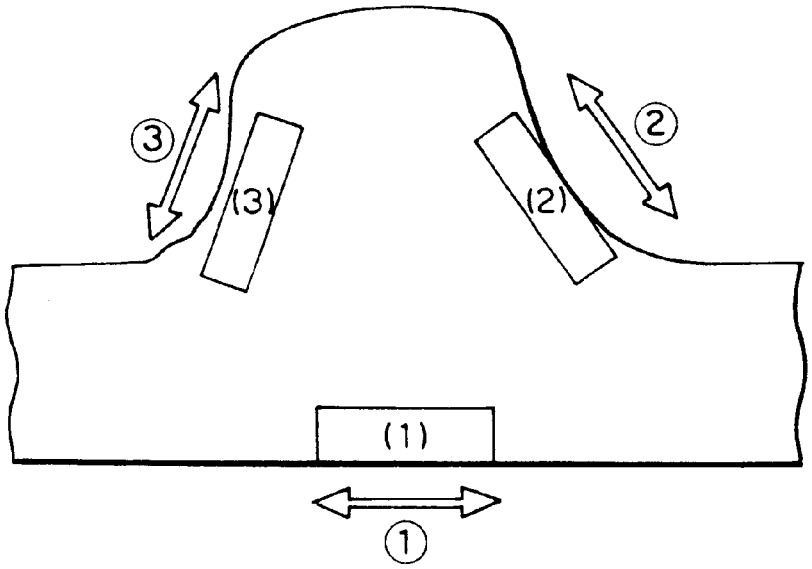
FIG. 12 is an explanatory diagram showing orientation of resin material of the molded surface fastener of the present invention.

Consequently, combination of the orientation of resin material in the molding direction of the flat substrate 11 and the aforementioned orientation leads to an increase of tensile strength in the molding direction of the entire surface fastener. When five test pieces taken from a single engaging element by slicing the surface fastener 10 produced in the above described molding in parallel to the molding direction were observed through polarization microscope photography, the following were recognized. When each of orientations, i.e. in a first direction ① along the flat substrate 11, a second direction ② along the front face of each engaging element 12 and a third direction ③ along the rear face of each engaging element 12 of the surface fastener 10 as shown in FIG. 12 is compared with the orientation in the other directions each of the other respective portions, it was found that the orientation of the corresponding direction is larger than the orientations of the other directions, as shown in Table 1. A degree of orientation in Table 1 is not an absolute value, but a relative value to the other orientations. The respective degrees of orientation is expressed based on a value 1.

TABLE 1

| Measuring position | Degree of orientation (1) | Degree of orientation (2) | Degree of orientation (3) |
|---|---|---|---|
| Orientation direction ① | 1 | 0.58 | 0.43 |
| Orientation direction ② | 0.54 | 0.70 | 1 |
| Orientation direction ③ | 0.55 | 1 | 0.65 |

Figure 13:
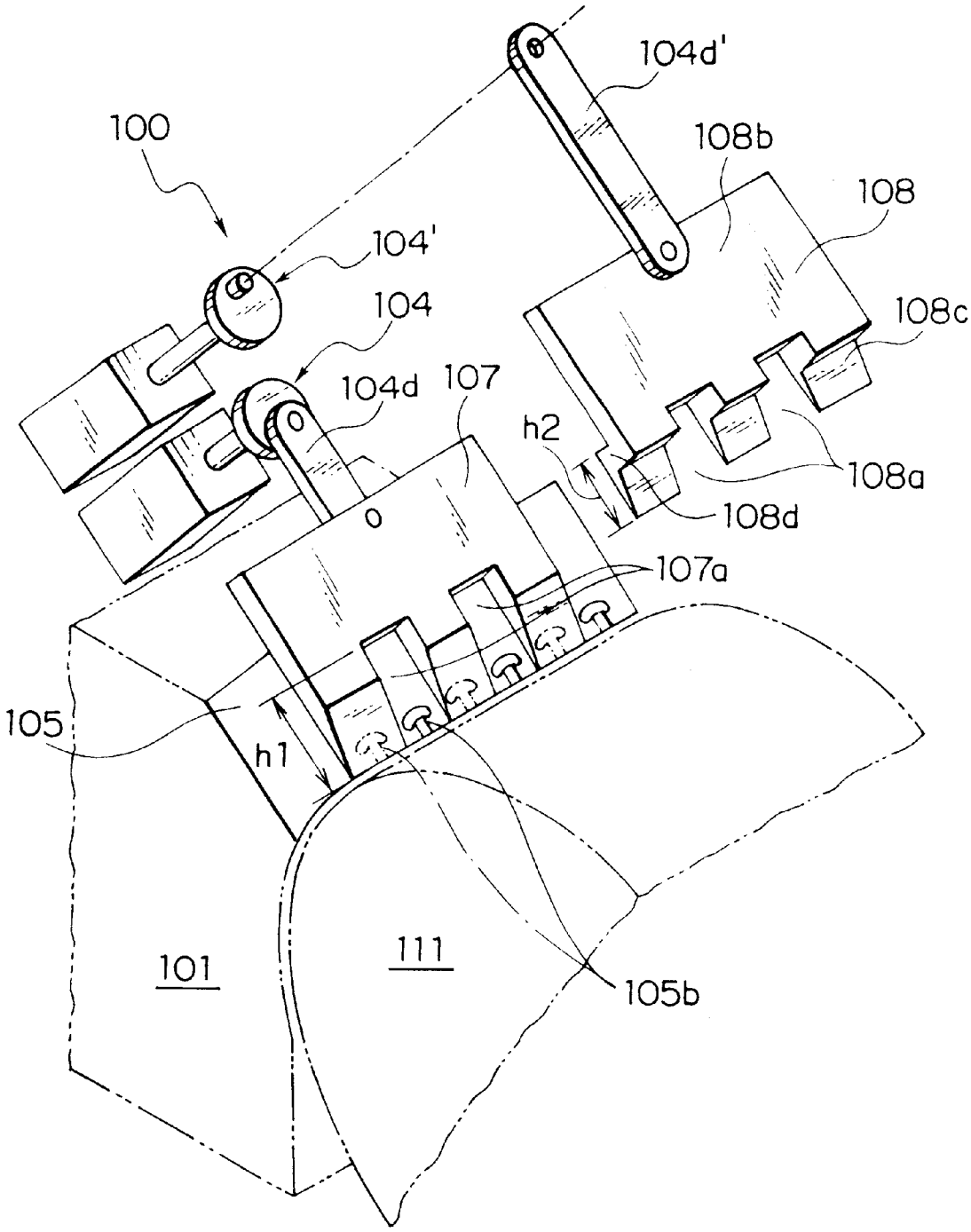
FIG. 13 is a perspective view partially showing a modification of the apparatus according to the first embodiment of the present invention.

FIG. 13 shows a first modification of the apparatus of the above described embodiment. This modification comprises an extrusion nozzle 105 having the same structure as the aforementioned first embodiment, a pair of first vertically vibrating member 107 and second vertically vibrating member 108 disposed in front of the extrusion nozzle 105 and crank mechanisms 104, 104' connected to the respective vertically vibrating members 107 and 108 through links 104*d*, 104*d*' lifting up/down the first and second vertically vibrating members 107, 108. The other structure is the same as the first embodiment.

According to this embodiment, likewise the first embodiment, the extrusion nozzle 105 contains six engaging-element-molding openings 105*b*. On the other hand, the first and second vertically vibrating members 107, 108 are made of comb teeth like metallic plate-like members each having two vertically elongated rectangular slits 107*a*, 108*a*.

The rectangular slits 107*a* of the first vertically vibrating member 107 and the rectangular slits 108*a* of the second vertically vibrating member 108 basically have equal slit widths and the slit disposition intervals are also equal. However, the first vertically vibrating member 107 is different from the second vertically vibrating member 108 in their entire configuration. That is, the upper half portion of the first vertically vibrating member 107 has a flat plane of substantially equal thickness and the lower half portion thereof is formed in a wedge like cross section as in the first embodiment. A slit height h1 of the rectangular slit 107*a* extends to near an upper end of the aforementioned thick portion.

On the other hand, a thick portion 108*b* of the second vertically vibrating member 108 as that of the first vertically vibrating member 107 is joined to a wedge cross section portion 108*c* having the same wedge like cross section as that of the first embodiment through a connecting portion 108*d* protruded, like a step, in an opposite direction to the molding direction from a lower end of the thick portion 108*b*. The rectangular slit 108*a* of this second vertically vibrating member 108 is formed so as to extend up to an upper end of the connecting portion 108*d*. The height h2, which is a sum of each wedge cross section portion 108*c* and each connecting portion 108*d*, is set to a sufficient height such that it fits in the rectangular slit 107*a* of the first vertically vibrating member 107 and is lifted up and down within the slit 107*a* so that the engaging elements 12 can be molded with the molten resin extruded from the engaging-element-molding openings 105*b*.

The respective rectangular slits 107*a*, 108*a* of the first vertically vibrating member 107 and the second vertically vibrating member 108 are formed such that they are deviated in either of the right and left sides of the vertically vibrating members 107, 108 to avoid overlapping of the rectangular slits 107*a*, 108*a*. The first vertically vibrating member 107 and the second vertically vibrating member 108 are disposed so as to be deviated by a pitch of each of the respective rectangular slits 107*a*, 108*a*. Then, the connecting portion 108*d* and wedge cross section portions 108*c* of the second vertically vibrating member 108 are engaged with the rectangular slits 107*a* from the front side of the first vertically vibrating member 107.

By operating the crank mechanisms 104, 104' for lifting up and down the first and second vertically vibrating members 107, 108 connected through the links 104*d*, 104*d*', the first vertically vibrating member 107 and the second vertically vibrating member 108 are lifted up and down such that they are in a firm contact with the second engaging-element-molding openings 105*b* of the extrusion nozzle 105. At this time, the first and second vertically vibrating members 107, 108 are driven alternately such that after one of the vertically vibrating members finishes its ascent or descent, the other one starts its ascent or descent.

According to an example as shown here, three rows of the engaging elements 12 are molded with the molten resin extruded from the engaging-element-molding openings 105*b* of odd rows from the left by the first vertically vibrating member 107 and then, three rows of the engaging elements 12 are molded with the molten resin extruded from the engaging-element-molding openings 105*b* of even rows from the left by the second vertically vibrating member 108. That molding mechanism is the same as that of the molding apparatus of the first embodiment. In the surface fastener molded in this manner, there are formed a plurality of the engaging elements 12 are disposed in staggered arrangement and standing integrally from the surface of the flat substrate 11. The shape of each of the engaging elements 12 according to this modification is the same as that of the engaging element 12 shown in FIG. 1.

Figure 14:
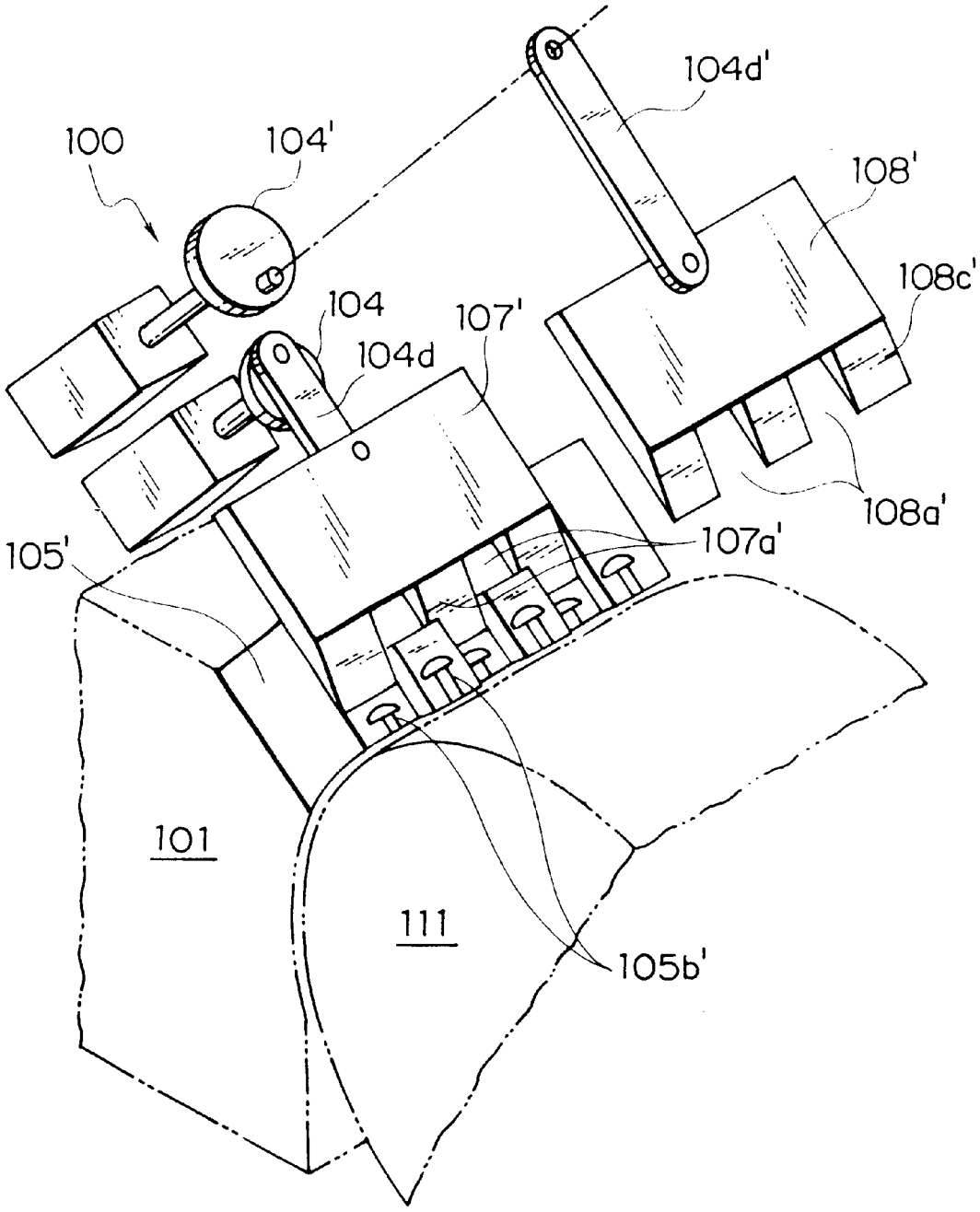
FIG. 14 is a perspective view partially showing another modification of the apparatus of the present invention.

FIG. 14 shows another modification of the molding apparatus of the first embodiment. This modification also achieves molding of the surface fastener having engaging elements 12 disposed an staggered arrangement. In an apparatus of this modification, the second engaging-element-molding openings 105*b*' of the extrusion nozzle 105', the first vertically vibrating member 107' and the second vertically vibrating member 108' have different structures from the apparatus of the above described modification while the other structures are substantially the same.

In the extrusion nozzle 105', plural openings 105*b*' of even rows from the left among the first engaging-element-molding openings 105*b*' (six openings in the example as shown here) on the front opening portion of the extrusion nozzle 105' are protruded forward by an amount equal to a thickness of the first vertically vibrating member 107'. Further, the openings 105*b*' of the even rows are set longer in height than those of the openings 105*b*' of odd rows. The first vertically vibrating member 107' is made of comb-teeth-like metallic plate-like member whose lower half portion has a wedge like cross section and which contains two rectangular slits 107*a*' to slidably fits on side faces of the protruded first engaging-element-molding openings 105*b*' respectively.

The lower half portion of the second vertically vibrating member 108' is also made of metallic plate-like member comprising wedge-like cross section portions 108*c*' disposed so as to oppose the aforementioned rectangular slits 107*a*' rectangular slit 108*a*' formed between those wedge like cross section portions 108*c*'.

For molding a molded surface fastener by using a molding apparatus having such components, the two rectangular slits 107*a*' of the first vertically vibrating member 107' is fitted onto the side faces of the first engaging-element-molding openings 105*b*' protruded forward of the extrusion nozzle 105' in a sliding contact thereto and then, the wedge cross section portions 108*c*' of the second vertically vibrating member 108' are disposed such that they are in a sliding contact with the front face of the first engaging-element-molding openings 105*b*'. Then, by repeatedly lifting up and down the first and second vertically vibrating members 107', 108' alternately, the engaging elements are disposed in staggered arrangement on the surface of the flat substrate (not shown), and the molded surface fastener having a plurality of the first engaging elements different in height in every pair of adjacent rows is molded continuously.

Figure 15:
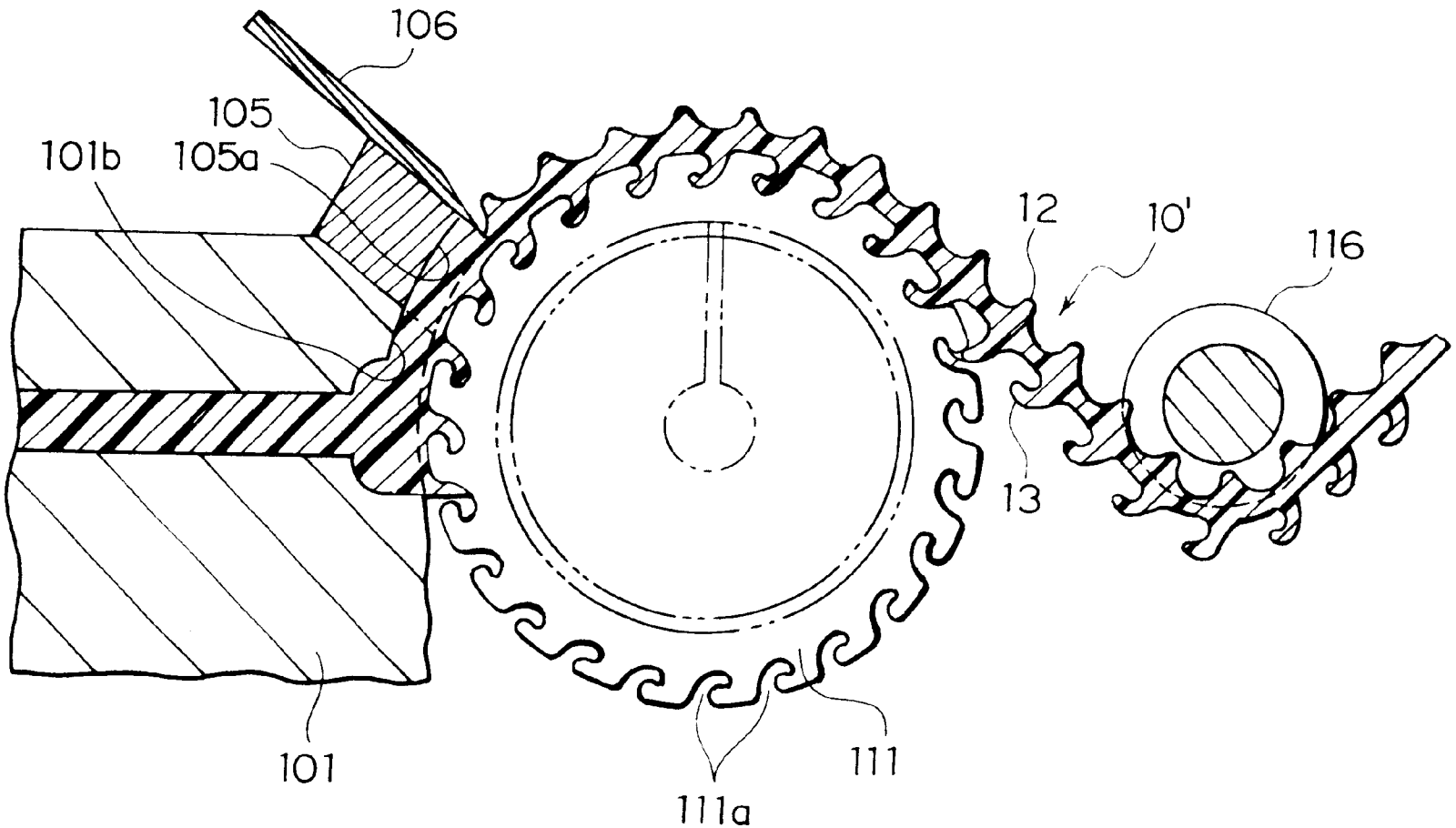
FIG. 15 is a schematic side view, partially broken away, showing an example of the molding apparatus for double-sided molded surface fastener, which is a third embodiment of the molding apparatus of the present invention.

FIG. 15 shows a molding apparatus of a third embodiment of the present invention. This molding apparatus is essentially different from the first embodiment in a cooling drum 111.

In this embodiment also, the cooling drum 111 which is driven and rotated in one direction is disposed with a gap corresponding to a thickness of a flat substrate 11 facing the extruding die 101 of the extruder 100. The aforementioned extrusion nozzle 105 is provided at an end portion of the extruding die 101 in the rotation direction of the drum 111. The resin extrusion path 105*a* of this extrusion nozzle 105 and the molten resin flow path 101*b* of the extruding die 101 communicates with each other along a peripheral face of the cooling drum 111. A plurality of the first engaging-element-molding openings 105*b* each having any arbitrary shape, for example, T-shaped cross section, are formed and arranged laterally in the front face of the extrusion nozzle 105. Then, the vertically vibrating member 106 which opens/closes the first engaging-element-molding openings 105*b* in a vertical direction is disposed in a firm contact with the front face of the extrusion nozzle 105. The vertically vibrating member 106 is vibrated vertically by a vibrating means (not shown). The molding apparatus of this embodiment has substantially the same structure as that of the first embodiment, except the above-mentioned structure of the cooling drum 111.

The cooling drum 111 of the molding apparatus according to this embodiment is different from the cooling drum 111 of the first embodiment in that a plurality of second engaging-element-molding cavities 111*a* are formed on a peripheral face thereof. Therefore, a double-sided molded surface fastener 10' in which the first engaging elements 12 and the second engaging elements 13 are molded integrally on the front and rear faces of the flat substrate 11 is molded continuously.

A molding mechanism for the double-sided molded surface fastener 10' having a typical shape according to the molded surface fastener molding apparatus having such a structure will now be described below. Molten resin is extruded from the extruding die 101 of the extruder toward a peripheral face of the cooling drum 111. The cooling drum 111 is driven and rotated in one direction (clockwise direction in the example as shown here) by a driving source (not shown). Most of the molten resin extruded from the extruding die 101 to the peripheral face of the cooling drum 111 is carried by the peripheral face and cooled as being revolved with a rotation of the cooling drum 111. Part of the molten resin is pushed into the second engaging-element-molding cavities 111*a* formed in the peripheral face of the cooling drum 111 so as to mold the second engaging elements 13 in succession.

The molten resin carried by the peripheral face of the cooling drum 111 and revolved reaches the first engaging-element-molding openings 105*b* of the extrusion nozzle 105 provided in the downstream through the resin extrusion path 105*a* and is extruded forward from the openings 105*b*. At this time, the vertically vibrating member 106 is vibrating vertically at a predetermined speed on the front face of the extrusion nozzle 105. The half-molten resin having a T-shaped cross section extruded from the extrusion nozzle 105 is molded to the first engaging elements 12 and the flat substrate 11 by the vertically vibrating member 106 which vibrates vertically on the front face of the extrusion nozzle 105, like the first embodiment.

According to the embodiment as shown here, an upper limit position of the vertically vibrating member 106 corresponds with an upper limit position of the first engaging-element-molding openings 105*b*, in other words, an upper limit position of the engaging-head portion-molding portions 105*b*-2. The lower limit position of the vertically vibrating member 106 is such a position that it leaves a thickness of the flat substrate 11 relative to the peripheral face of the cooling drum 111 as described above.

Therefore, the molten resin extruded from the extruding die 101 toward the peripheral face of the cooling drum 111 is revolved while molding the second engaging elements 13 on the rear side of the flat substrate 11, as being cooled positively by the cooling drum 111. When it reaches the extrusion nozzle 105, the resin becomes half hardened, and the flat substrate 11 and the first engaging elements 12 are molded on the surface by the vertically vibrating member 106 and at the same time.

Figure 16:
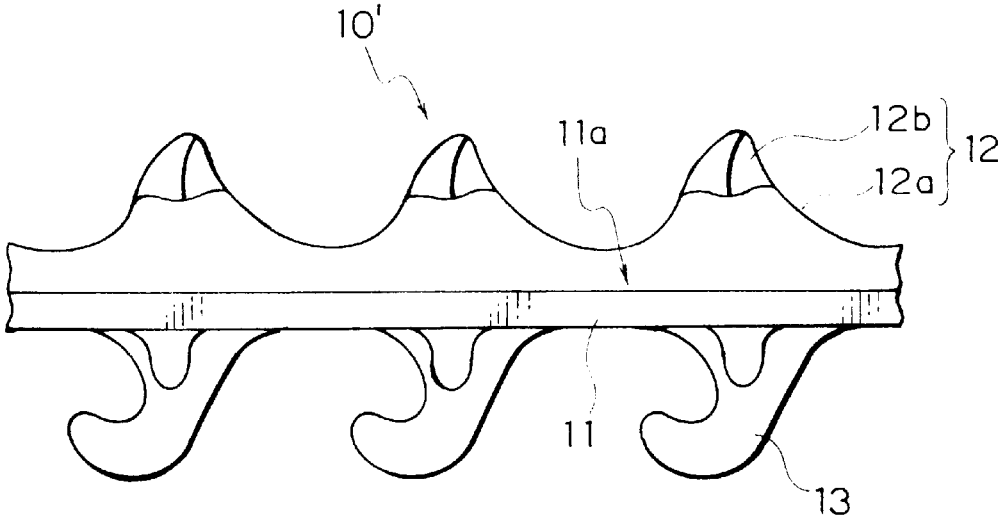
FIG. 16 is a side view partially showing an example of a shape of the double-sided molded surface fastener produced by the apparatus according to the present invention.

As for a shape of each first engaging element 12 molded in this manner, as viewed from front, an engaging head portion 12*b* assumes a substantially T shape such that it is curved in an arc from a top end of the stem portion 12*a* downward, protruding to the right and left. If this first engaging element 12 is viewed from side, as shown in FIG. 16, the thickness of the engaging element increases gradually from a top portion of the engaging head portion 12*b* to a base end of the stem portion 12*a* standing from the flat substrate 11. This gradual increase of the thickness is applied to not only the stem portion 12*a* but also the engaging head portion 12*b*. That is, the thickness of the engaging head portion 12*b* increases gradually in a direction perpendicular to the protruding direction of the engaging head portion 12*b* as it goes downward. Such a gradual increase can be made freely by changing a lift-up/down speed of the vertically vibrating member 106.

Further, the shape and physical property of the first engaging element 12 molded in the above manner is not different from the first engaging element 12 molded by means of the molding apparatus of the first embodiment and have all the features of the present invention. Furthermore, each second engaging element 13 molded on a back side of the flat substrate 11 by this molding apparatus has an ordinary hook shape as shown in FIG. 16.

Figure 17:
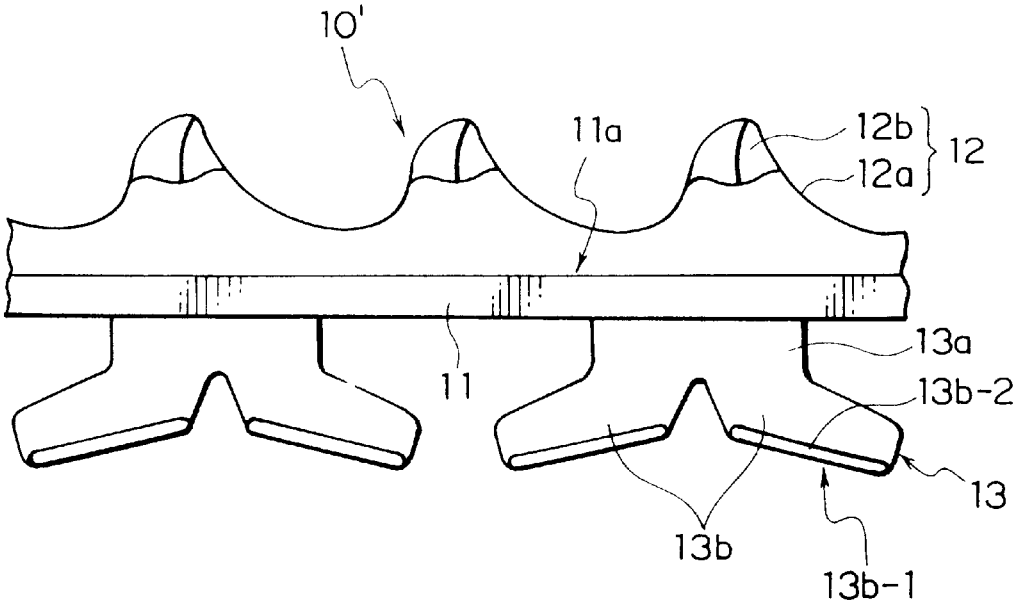
FIG. 17 is a side view partially showing another embodiment of the double-sided molded surface fastener produced by the apparatus according to the present invention.

FIG. 17 shows another double-sided molded surface fastener 10' in which the first engaging element 12 thereof is the same as the first engaging element 12 shown in FIG. 1, but the shape of the second engaging element 13 molded on the back side of the flat substrate 11 is modified. According to this example, the second engaging element 13 is entirely shaped in substantially inverted Y letter and a substantially inverted V-shaped groove reaching the stem portion 13*a* is formed in a border portion between the stem portion 13*a* and the engaging head portion 13*b* extending in a back and forth direction. Further, the second engaging element 13 has a flat surface 13*b*-1 on a top portion of the engaging head portion, and bulging portions 13*b*-2 which bulge in the right and left directions on the same plane, in the plan view from the top portion. Details of a structure, operation, effect and manufacturing method thereof have been disclosed in a specification of U.S. Pat. No. 5,781,969.

When the vibration speed of the vertically vibrating member 106 slows down, the first engaging element 12 becomes thicker in the molding direction. The vibration speed of the vertically vibrating member 106 may be varied in every other row of the first engaging elements 12 in the molding direction or may be randomly varied.

As understood from the above description, because in the molded surface fastener of the present invention, the first engaging elements 12 can be molded on the surface of the flat substrate 11 or the first engaging elements 12 and the second engaging elements 13 can be molded on the front and back surfaces thereof respectively, integrally and continuously by a single manufacturing process, the manufacturing system does not have to be largely modified as compared to the conventional methods and apparatuses so as to improve productivity and reduce equipment space. Particularly by achieving a slight improvement on the molding apparatus as the conventional ones, the present invention can be achieved, so that equipment cost can be kept low.

Particularly, the shape of the first engaging element 12 is a novel one which is impossible to be molded according to the conventional methods and further, it can be changed in various ways. Thus, it can be modified to a preferable shape corresponding to the engaging/disengaging characteristic of the second engaging element 13 molded on the back side of the substrate 11 and characteristic of a product which the engaging element 13 engage. Further, the first engaging element 12 of the present invention provides a feel of touch, as compared to conventional molded surface fasteners produced by extrusion-molding plural rows of ribs each of which has an engaging element cross section extending on a substrate together with the substrate, cutting the ribs at a predetermined pitch in its longitudinal direction and then, drawing the substrate so as to separate individual engaging elements. Furthermore, by selecting a shape of the first engaging-element-molding openings 105*b*, 105*b*' in the extrusion nozzle 105, 105' arbitrarily, engaging elements having diversified dimensions and shapes may be molded on the substrate 11 at the same time. Therefore, even if a mating loop material contains loops of diversified sizes, a desired engagement rate and engaging force can be secured.

What is claimed is:

1. A molding method for molded surface fastener for molding a flat substrate and a plurality of first engaging elements integrally and continuously using the same molding material, comprising:

driving and rotating a cooling and transportation means for cooling and transporting a molded surface fastener in one direction at the same time that it is molded;

extruding molten resin material continuously onto a cooling and transportation face through a resin extrusion path which extends in a width direction of an extrusion nozzle and which is open to said cooling and transportation face of said cooling and transportation means and opens in a resin transportation direction thereof; and opening and closing a plurality of first engaging-element-molding openings spaced in the width direction of said resin extrusion path by means of at least a vertically vibrating member comprised of a plate-like member disposed on a front face of said extrusion nozzle in said transportation direction thereof.

2. A molding method according to claim 1 further comprising a step of molding a plurality of second engaging elements integrally on a surface of the flat substrate on an opposite side to the surface on which the first engaging elements are molded at the same time.

* * * * *